United States Patent [19]

Post

[11] 4,380,165

[45] Apr. 19, 1983

[54] SQUEEZER FLANGER

[75] Inventor: Willem P. Post, Diepenveen, Netherlands

[73] Assignee: Thomassen & Drijver-Verblifa N.V., Derventer, Netherlands

[21] Appl. No.: 266,280

[22] Filed: May 22, 1981

[51] Int. Cl.[3] ..... B21D 22/00

[52] U.S. Cl. ..... 72/355; 72/370; 72/401; 72/402

[58] Field of Search ..... 72/355, 370, 401, 402

[56] References Cited

U.S. PATENT DOCUMENTS

| | | | |
|---|---|---|---|
| 517,738 | 4/1894 | Edgar et al. | 72/355 |
| 2,343,006 | 2/1944 | Gibbs | 72/355 |
| 2,691,906 | 10/1954 | Finch | 72/355 |
| 2,828,538 | 4/1958 | Darden | 72/355 |
| 3,509,755 | 5/1970 | Bulgur | 72/355 |
| 3,913,373 | 10/1975 | Kindez | 72/355 |
| 4,267,719 | 5/1981 | Walker | 72/402 |

FOREIGN PATENT DOCUMENTS

| | | | |
|---|---|---|---|
| 103877 | 8/1926 | Austria | 72/355 |
| 211362 | 2/1965 | Sweden | 72/355 |

*Primary Examiner*—Leon Gilden

*Attorney, Agent, or Firm*—John J. Kowalik

[57] ABSTRACT

To prevent fold formation when arranging a circumferential flange and a circular constriction adjoining the same, the material of the sleeve body is locally arrested under a sufficient clamping force between the inner and outer segments of a deformation device.

11 Claims, 12 Drawing Figures

SQUEEZER FLANGER

Method and device for manufacturing a sleeve body having at least at one open end an outwardly directed circumferential flange and a circular constriction adjoining the same.

The invention relates to a method of manufacturing a sleeve body having an outwardly directed circumferential flange arranged at the side of an open end and a circular constriction adjoining the same by pressing a substantially cilindrical sleeve body near one opening thereof along the entire circumference with the aid of a plurality of radially inwardly and outwardly movable outer segments, the form of the inner surace of which corresponds with the form to be imparted to the constriction, at the same time on all sides inwardly against an inner support, the diameter of which can be reduced.

Such a method is known and carried out on a sleeve body, the rim of which around the opening is slightly flaring by narrowing it with the aid of radially and inwardly moving segments, the inner side being supported by a conical surface, which provides by axial displacement a support of gradually smaller diameter.

It is also known to narrow the sleeve body on the inner side only partly i.e. only on the side directed to the opening whilst supporting it. Both methods have disadvantages, since for example considerable limitations are imposed to the shape of the narrowed part and furthermore the method can only be carried out on a sleeve body already widened at the opening. Due to the partial support on the inner side folds can be readily formed in the narrowed part. It is finally known to slightly support the inner side of the part to be narrowed with the aid of a rubber elastic element.

In this method again formation of folds cannot be avoided, particularly in the case of metal of small thickness or having thickness variations.

The invention has for its object to obviate said disadvantages and provides to this end a method of the kind set forth in the preamble, which is characterized in that the inner support, the form of the outer surface of which at least partly matches that of the inner surface of the desired constriction, is loaded by a spring force having a radial, outwardly directed component, which exceeds the force required for the radial narrowing of the sleeve body, but which is smaller than the radially directed force by which the outer segments are pushed inwardly.

This method is preferably carried out in successive steps, in which first the support the outer face of which at least partly matches the inner form of the constriction, is brought into engagement with the inner side of the sleeve body, subsequently the outer segments are moved inwardly, whilst the support is not displaced until the sleeve body is locally deformed in accordance with the inner profile of the segments and the outer profile of the support, after which the support is inwardly displaced in a radial direction at the same rate as the outer segments until the desired constriction is obtained, whilst the free edge of the sleeve body is axially loaded towards the segments. By the combination of the above described steps the deformation of the sleeve body can be accurately controlled, whilst a cilindrical sleeve body can be employed as the starting material which need not be previously provided with a flaring rim.

In order to remove the deformed sleeve body from the deforming device, the parts thereof are moved in the opposite direction, so that the sleeve body is set free of the segments and the support can be removed.

Loading the free rim of the sleeve body in downward direction towards the segments is preferably carried out by inserting an accurately fitting, undeformable ring into the open end of the sleeve body near the desired constriction, along a free end of said ring the outer segments are radially moved inwardly, whilst the ring is axially loaded towards said segments. In this manner the deformed flange will be satisfactorily flat even in the case of a minor thickness of the material and of irregular surfaces of the material.

The invention furthermore relates to a device for manufacturing a sleeve body having at least at one open end an outwardly directed circumferential flange and a circular constriction adjoining the same, said device comprising a support for a sleeve body, outer segments radially movable inwardly and outwardly and together exhibiting on the inner side the form of the desired constriction, inner segments radially movable outwardly and inwardly having an outer surface at least partly identically equal to the inner surface of the outer segments and driving members for inwardly and outwardly moving the two kinds of segments.

Such a device is known and it comprises driving members moving the inner segments outwardly and the outer segments simultaneously inwardly, so that between them the rim of the sleeve body is deformed. With such an operation a large part of the deformed rim of the sleeve body is necessarily left without support, so that formation of folds cannot be avoided. It is also known to first move the inner segments into engagement with the inner wall of the sleeve body and to subsequently move the outer segments towards the inner segments then blocked, in which case, however, the inconvenience mentioned above also occurs.

In order to avoid these imperfections the device according to the invention is characterized in that the driving members for the segments are designed so as to be able to arrest the inner segments until the outer segments have inwardly moved to an extent such that the segments and the sleeve body between them join one another in a radial direction and to subsequently displace inwardly all segments in a radial direction at the same rate.

In this manner a reliable deformation of the sleeve body is obtained, whilst nevertheless a comparatively large constriction can be made without the formation of folds. For the reason described above the device is preferably provided in addition with an annular element accurately fitting in an open end of the non-deformed sleeve body and being displaceable between a position in which it extends in the sleeve body and a position in which it is removed therefrom.

A very suitable embodiment of the device according to the invention is obtained when the inner segments are united to form tightening pincers, the segments of which are displaceable in a conventional manner by means of a conical control member against the action of spring elements. In a preferred embodiment the annular element has a freely protruding head face located in a radial plane, which provides the possibility of moving the outer segments inwardly along said face whilst an accurately defined gap is maintained for accommodating the material of the sleeve body forming the flange. Said head face maintains the flatness of said flange throughout the desired width. It is advisable to lock the flange with some pressure between the outer segments and the annular element, for which purpose the annular element is preferably loaded towards said outer segments with the aid of a compression spring.

The invention will be described more fully with reference to the accompanying drawing.

Figure 6:
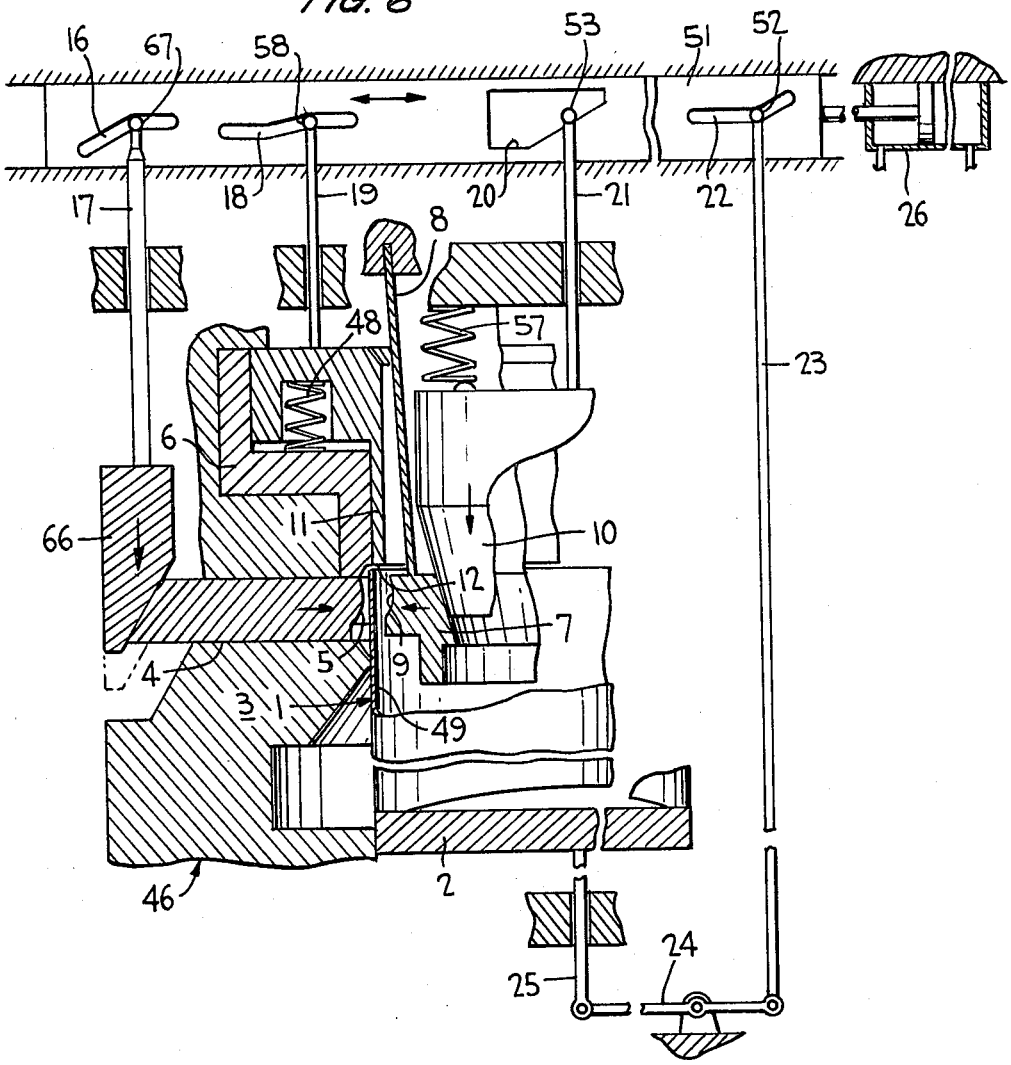

FIG. 6 schematically shows control means for the device of FIGS. 1 to 5.

Figure 7:
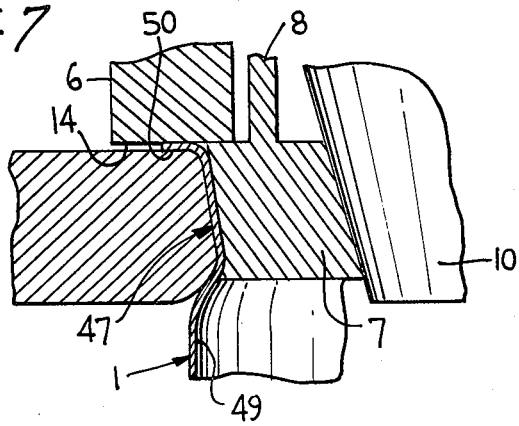

FIG. 7 is an axial sectional view of a variant of a device embodying the invention.

Figure 8:
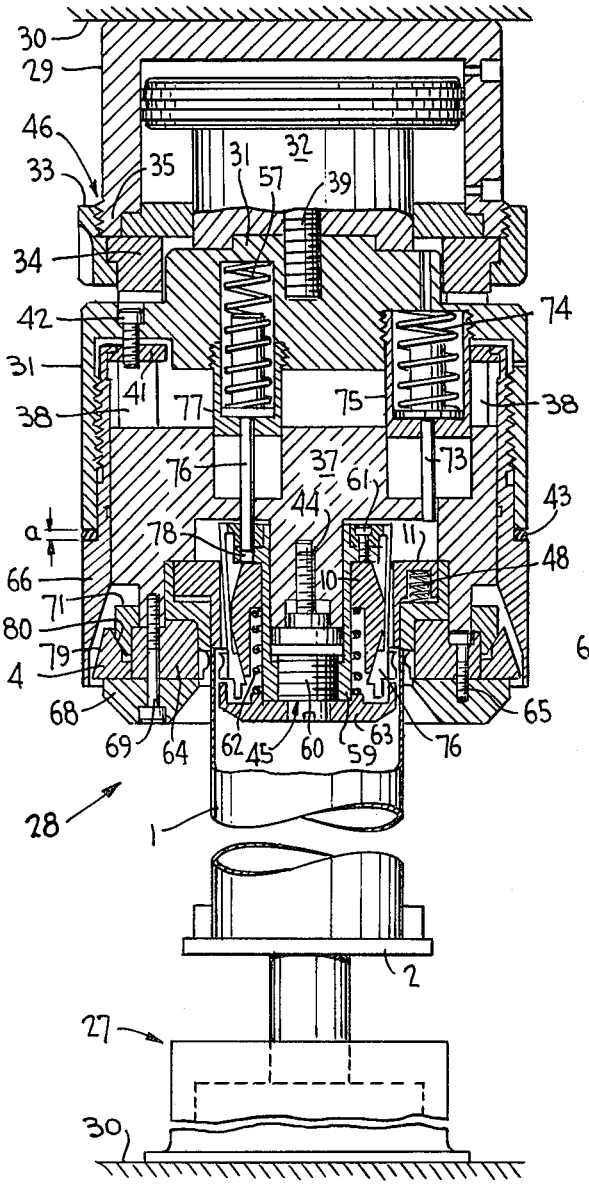
Figure 9:
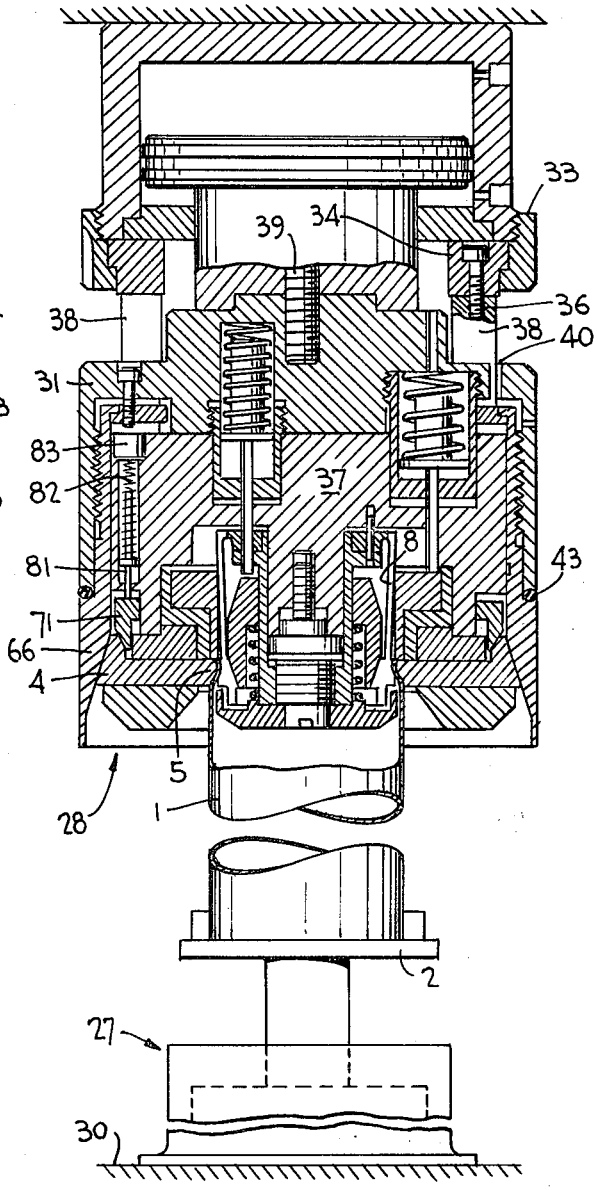

FIGS. 8 and 9 show two different positions of a practical embodiment of a device in accordance with the invention.

Figure 10:
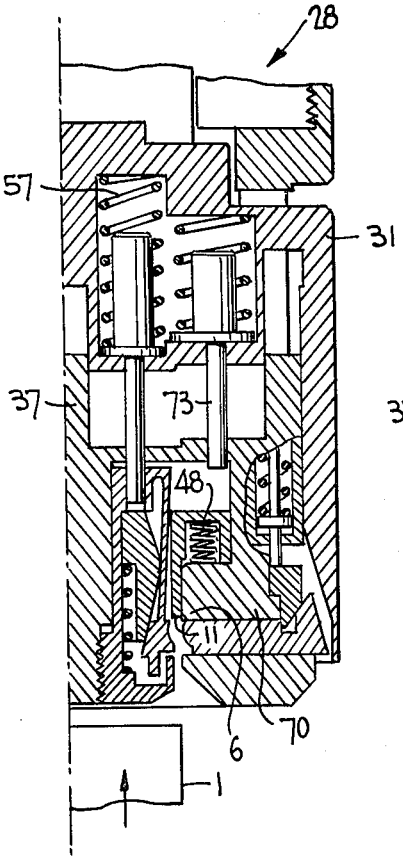
Figure 11:
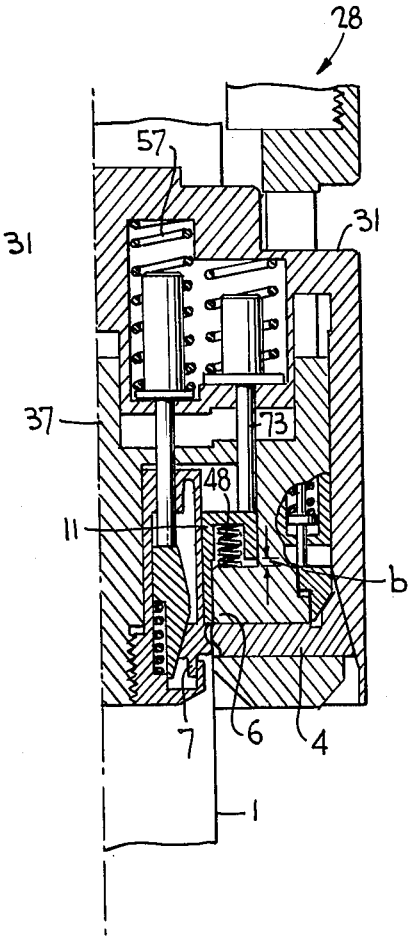
Figure 12:
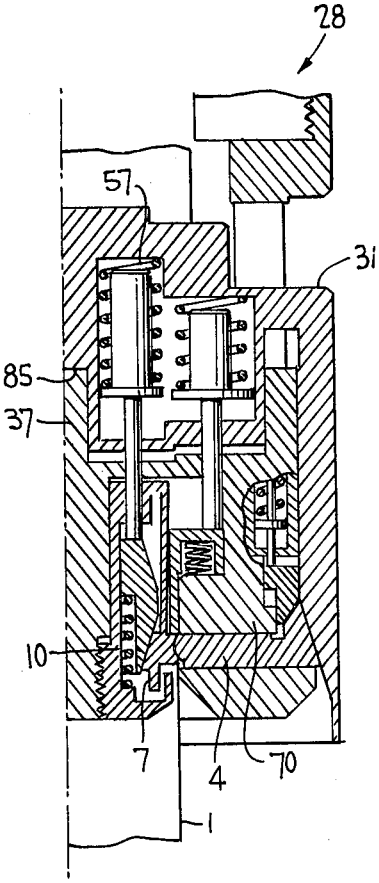

FIGS. 10, 11 and 12 show somewhat more schematic sectional views of the device of FIGS. 8 and 9 in successive stages during the execution of the method according to the invention.

FIGS. 1 to 5 show a preferred embodiment of a device according to the invention. This device comprises a holder 46 for the sleeve body 1 to be deformed consisting of a bottom support 2 and a guide ring 3, the latter serving to center the sleeve body 1. Above the guide ring 3 a coaxial crown of radially inwardly and outwardly movable outer segments 4 is arranged, the surface 5 of which matching on the inner side the form of the constriction 47 to be made in the sleeve body 1. With the aid of a stop ring 6 pressed down by means of a compression spring 48 in the axial direction of the sleeve body 1 this sleeve body is clamped to the bottom support 2, so that during the deformation the sidewalls 49 of the sleeve body 1 can be constantly exposed to pressure.

On the inner side of the sleeve body 1, in the same radial plane as the outer segments 4, a crown of inner segments 7 is provided, the outer surface 9 thereof matching the inner form of the desired constriction 47. On the radially inward side the inner segments 7 have a conical surface along which a matching, conical control element 10 is axially displaceable, thus being capable of outwardly moving the inner segments against the spring action of the resilient lamellae 8.

Inside the stop ring 6 an annular element 11 accurately fitting in the open end of the non-deformed sleeve body 1 is concentrically arranged.

Figure 1:
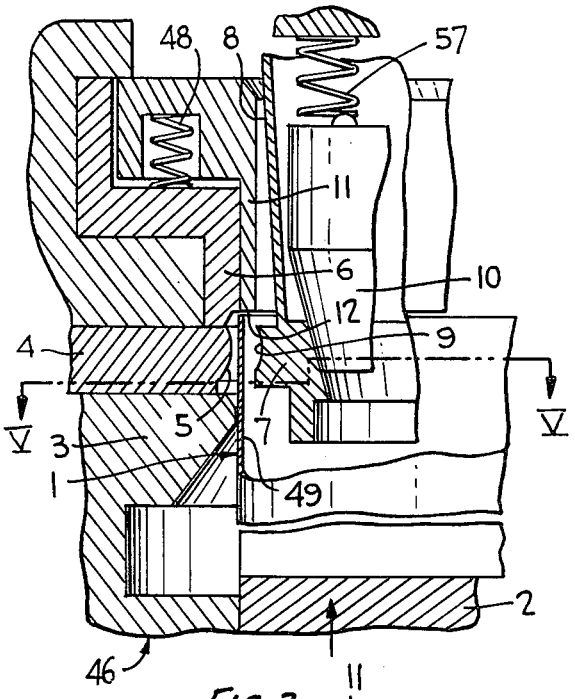
FIG. 1 is a schematic, axial sectional view of a device in accordance with the invention in its starting position.
Figure 2:
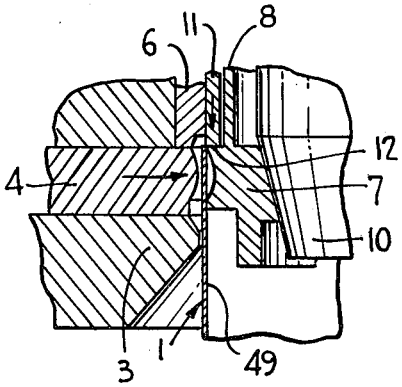
FIG. 2 is a detail of a similar sectional view of said device in a second position.
Figure 3:
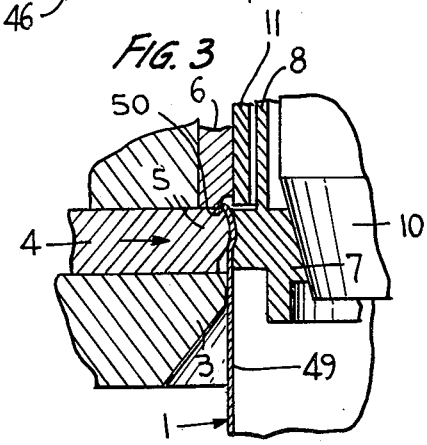
FIGS. 3 and 4 are sectional views corresponding to FIG. 2, the device being in two subsequent positions.

The device operates as follows: the sleeve body 1 is moved from the bottom side through the guide ring 3 against the fixed stop ring 6, whilst being supported by the bottom support 2 axially movable up and down and holding the sleeve body 1 in contact with the stop ring 6 (FIG. 1). Thus the control element 10 is moved axially downwards until the inner segments 7 engage the sleeve body 1. In addition, the stop ring 11 is moved downwards into the open end of the sleeve body 1, so that the head face 12 is located just above the top surface of the outer segments 4 (FIG. 2). Subsequently the outer segments 4 are simultaneously moved inwards in a radial direction, so that the sleeve body 1 is deformed in accordance with the profile of the outer and inner segments 4 and 7. The top edge 50 of the sleeve body 1 is then retained by the annular element 11 and the inner segments 7 are blocked by the control element 10 then standing still (FIG. 3).

Figure 4:
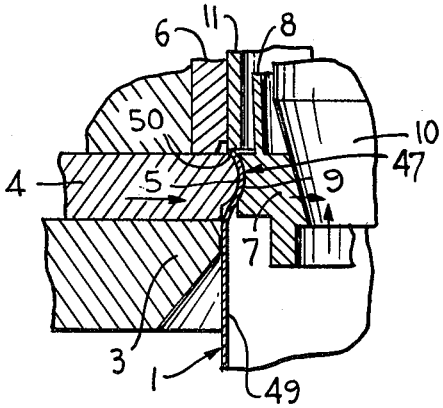
Figure 5:
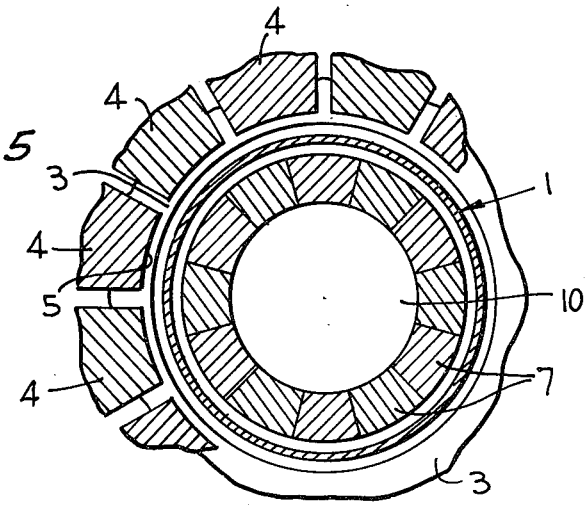
FIG. 5 is a schematic cross-sectional view taken on the line V—V in FIG. 1.

Simultaneously with the inward movement of the outer segments 4 the control element 10 is lifted, so that the inner segments simultaneously move inwardly under the action of the resilient lamellae 8 at the same rate as the outer segments 4. Thus the diameter of the constriction 47 is reduced, whilst the top edge 50 is maintained in a flat state by the annular element 11 downwardly loaded by the spring 48 (FIG. 4). After a reverse movement of the deforming elements into the state shown in FIG. 1 the deformed sleeve body 1 can be removed from the device.

FIG. 6 shows quite schematically, by way of example, the control means of the device of FIGS. 1 to 5. A hydraulic ram 26 moves a cam disc 51 in a horizontal direction in a reciprocatory manner during each cycle of treatment. The bottom support 2 moves up and down by means of a rod system 25, 24, 23 and a curve slot 22 with a guide roller 52. The control element 10 moves up and down by means of a guide rod 21 with a guide roller 53, which is guided only on the lower side in a curved slot 20. A compression spring 57 tends to move downwards the control element 10 and ensures the pressure of the inner segments 7 by an outwardly directed, radial force, which exceeds the force required for the inward deformation of the sleeve rim, but which is smaller than the radially directed force by which the outer segments 4 are driven inwardly. The ring 11 is actuated by means of a rod 10 with a guide roller 58, which co-operates with a a slot 18. The outer segments 4 are controlled by means of a conical ring 66 and a rod 17 with a guide roller 67 engaging a slot 16.

A simplified modified variant is illustrated in FIG. 7, in which a separate annular element 11 is failing, but the stop ring 6 has a flat head face 14 on the side facing the deformation segments 4 and 7. This stop ring 6 is moved downwards by the outer and inner segments 4 and 7 during the deformation of the sleeve rim 1 and it thus urges the top rim 50 against the top surface of the outer segments 4.

A practical embodiment of the device 28 of FIGS. 8 and 9 comprises, apart from the bottom support 2 driven up and down by means of hydraulic ram 27, a hydraulic ram 29. The hydraulic ram 27, like the hydraulic ram 29, is rigidly secured to a frame 30. To the hydraulic ram 29 is rigidly secured a holder and a sliding sleeve 31 is secured by a helical joint to the piston rod 32 of said hydraulic ram, so that it can slide up and down coaxially with the holder 46 with respect to the latter. The holder 46 comprises a screw ring 33 which fixes a ring 34 to a collar 35 of the hydraulic ram 29. To the ring 34 is secured a holder body 37 by means of upwardly extending extensions 38 of the holder body 37 and bolts 36 screwed into the latter. The extensions 38 extend through matching recesses 40 of the sliding sleeve 31. To the sliding sleeve 31 is fastened a conical ring 66 by means of a fastening ring 41, bolts 42 and a spacer ring 43, which determines the maximum inward deformation of the sleeve body 1 in accordance with its thickness a. To the bottm side of the holder body 37 is fastened by means of a bolt 44 a screw-threaded piece 45 onto which a guide sleeve 59 is screwed by means of screwthread 60. By means of a bolt 61 the resilient lamellae 8 of the inner segments 7 are connected with the guide sleeve 59. Between them is slidable a control element 10 constructed in the form of a conical ring around the guide sleeve 59, said element being driven upwards by a compression spring 62 bearing on a cup spring 63 screwed on the screw-threaded piece 45.

The outer segments 4 are guided in a radial direction by means of guide members 64, which are fastened by means of bolts 65 to a lower ring 68, which is, in turn, fastened by means of bolts 69 to the holder body 37, whilst the outer segments 4, a guide ring 6 and a conical reacting ring 71 are arranged between. The guide roller 6 axially guides an annular element 11, which is urged upwards by means of compression springs 48, but which can be moved downwards by means of push rods 73. For this purpose each push rod 73 is pressed downwards by a compression spring 74 arranged in a spring sleeve 75 screwed into the sliding sleeve 31. Likewise the control element 10 is each time actuated by downwardly driving push rods 76 by means of a spring sleeve 77 screwed into the sliding sleeve 31 with a compression spring 57. The push rods 76 extend through recesses 78 of the guide sleeve 59.

The outer segments 4 each have, apart from the outer wedge surface 79 co-operating with the conical ring 66, an inner wedge surface 80, which co-operates with the reacting ring 71. This reacting ring 71 is driven downwards by push rods 81, each of which is loaded by a compression spring 82, which bears on a plug 83 screwed into the holder body 37. FIGS. 10, 11 and 12 illustrate the operation of the device 28 and the relative positions of the parts thereof.

As shown in FIG. 10, the sleeve body 1 can be slipped into the device 28, the guide ring 6 forming a stop. This guide ring 6 is drawn in FIGS. 10–12 as part of a unity 70 integrated with the holder body (see FIG. 8). As soon as the push rods 73 strike the top side of the element 11 owing to the downward movement of the sliding sleeve 31, it is displaced downwardly over a small distance b against the compression springs 48, after which the element 11 centers the sleeve body 1 in the device 28. Upon a further downward movement of the sliding sleeve 31 the segments 4 and 7 shift towards the sleeve body 1 (see FIG. 11) and subsequently the outer segments 4 drive the sleeve body 1 locally inwardly by an inwardly directed, radial force component, which exceeds the outwardly directed, radial force exerted by the strong compression springs 57 via the control element 10 on the inner segments 7. These compression springs 57, for example three, may each have a bias stress of 8 to 10 kg and a depressed stress of, for example, 15 kg in the compressed state to deform a thin, drawn sleeve body 1 of a diameter of about 7 cm in order to ensure that the inner segments 7 are urged outwards by a greater force than is required for the inward deformation. A a result the deformed material is constantly subjected to adequate clamping force to prevent the formation of folds. The treatment is accomplished when, as shown in FIG. 12, the sliding sleeve 31 strikes a stop 85 of the holder body 37.

It is noted that in the sectional views of FIGS. 8 to 12 along the circumference are three times repeated parts, such as push rods, compression springs, extensions 38, bolts and the like.

I claim:

1. A method of manufacturing a sleeve body having an outwardly directed circumferential flange arranged at the side of an open end and a circular constriction adjoining the same by pressing a substantially cylindrical sleeve body near one opening thereof along the entire circumference with the aid of a plurality of radially inwardly and outwardly movable outer segments, the form of the inner surface of which corresponds with the form to be imparted to the constriction, at the same time on all sides inwardly against an inner support, the diameter of which can be reduced, characterized in that the inner support, the form of the outer surface of which at least partly matches that of the inner surface of the desired constriction, is loaded by a spring force having a radial, outwardly directed component, which exceeds the force required for the radial narrowing of the sleeve body, but which is smaller than the radially directed force by which the outer segments are pushed inwardly.

2. A method as claimed in claim 1, characterized in that first the support the outer face of which at least partly matches the inner form of the constriction is brought into engagement with the inner side of the sleeve body, subsequently the segments are moved inwardly, whilst the support is not displaced until the sleeve body is locally deformed in accordance with the inner profile of the segments and the outer profile of the support, after which the support is inwardly displaced in a radial direction at the same rate as the segments until the desired constriction is obtained, whilst the free edge of the sleeve body is axially loaded towards the segments.

3. A method as claimed in claim 1 or 2, characterized in that a non-deformable, accurately fitting ring is inserted into the open end of the sleeve body near the desired constriction and the flange, the segments are radially moved inwardly along a free end edge of said ring and the ring is loaded in an axial direction towards said segments.

4. A device for manufacturing a sleeve body having at least at one open end an outwardly directed circumferential flange and a circular constriction adjoining the same, said device comprising a support for a sleeve body, outer segments radially movable inwardly and outwardly and together exhibiting on the inner side the form of the desired constriction, inner segments radially movable outwardly and inwardly having an outer surface at least partly identically equal to the inner surface of the outer segments and driving members for inwardly and outwardly moving the two kinds of segments, characterized by spring means for loading the inner support, the form of the outer surface of which at least partly matches that of the inner surface of the desired constriction by a spring force having an outwardly directed, radial component, which exceeds the force required for the radially directed narrowing of the sleeve body, but which is smaller than the radially directed force of the driving means urging inwardly the outer segments.

5. A device as claimed in claim 4, characterized in that the driving means for the segments are designed so as to be able to arrest the inner segments until the outer segments have inwardly moved to an extent such that the segments and the sleeve body between them join one another in a radial direction and to subsequently displace inwardly all segments in a radial direction at the same rate.

6. A device as claimed in claim 4 or 5, characterized in that an annular element accurately fitting in an open end of the non-deformed sleeve body is displaceable between a position in which it extends in a sleeve body and a position in which it is removed therefrom.

7. A device as claimed in claim 4 or 5, characterized in that the inner segments are united to form tightening pincers.

8. A device as claimed in claim 6, characterized in that the annualar element has a freely protruding head face located in a radial plane.

9. A device as claimed in claim 6, characterized in that the annular element can be loaded towards the outer segments by the intermediary of a compression spring.

10. A device as claimed in claim 7, characterized in that the annular element can be loaded towards the outer segments by the intermediary of a compression spring.

11. A device as claimed in claim 8, characterized in that the annular element can be loaded towards the outer segments by the intermediary of a compression spring.

* * * * *

UNITED STATES PATENT AND TRADEMARK OFFICE

CERTIFICATE OF CORRECTION

PATENT NO. : 4,380,165

DATED : April 19, 1983

INVENTOR(S) : Willem P. Post

It is certified that error appears in the above-identified patent and that said Letters Patent are hereby corrected as shown below:

On the title page, after Item [22], insert:

[30] Foreign Application Priority Data

May 29, 1980 [NL] Netherlands 8003140

Signed and Sealed this

*Nineteenth* Day of *March 1985*

[SEAL]

*Attest:*

DONALD J. QUIGG

*Attesting Officer* *Acting Commissioner of Patents and Trademarks*